US005673764A

United States Patent [19]

Falgout, Sr.

[11] Patent Number: 5,673,764

[45] Date of Patent: Oct. 7, 1997

[54] DRILL STRING ORIENTING MOTOR

[76] Inventor: Thomas E. Falgout, Sr., 110 Charles Read St., Lafayette, La. 70503

[21] Appl. No.: 422,232

[22] Filed: Apr. 14, 1995

[51] Int. Cl.[6] ..... E21B 4/02

[52] U.S. Cl. ..... 175/101; 175/106

[58] Field of Search ..... 175/26, 38, 101, 175/106, 107

[56] References Cited

U.S. PATENT DOCUMENTS 5,156,223 10/1992 Hipp ..... 175/106 X
5,259,467 11/1993 Schoeffler ..... 175/38
5,297,641 3/1994 Falgout, Sr. ..... 175/73
5,311,952 5/1994 Eddison et al. ..... 175/61

*Primary Examiner*—William P. Neuder

[57] ABSTRACT

An orienting motor has an elongated body consisting of a housing end and an arbor end with a swivel arrangement to allow relative rotation of opposite ends for service as a length element of a drill string. The body has a bore to conduct drilling fluid moving in the drill string bore. A sensor in the body responds to commands transmitted from the surface in the form of drilling fluid flow rate manipulations to activate a drilling fluid powered motor to rotate opposite ends of the body, and hence, opposite ends of the attached drill string to change the azimuthal orientation of the lower end of the drill string relative to earth.

10 Claims, 3 Drawing Sheets

DRILL STRING ORIENTING MOTOR

This invention pertains to an orienting motor used as a length element of a fluid conducting drill string, in a well, to rotationally orient a downwardly continuing drill string portion relative to an upwardly continuing drill string portion. More specifically it uses the fluid power available from the fluid moving in the drill string bore to incrementally rotate axially spaced drill string elements relative to each other in response to fluid flow rate manipulations exercised at the surface to function as down link commands.

BACKGROUND

There are several reasons to rotationally move the lower end of a drill string relative to the upper end but none more compelling than those related to the use of coiled tubing in wells for drilling and workover.

The currently available down hole motors and Measurement While Drilling (MWD) logging instrumentation make it possible for coiled tubing to be used in activities once solely the province of assembled rotary drill strings. Currently available directional control equipment, however, often requires that the lower end of the string be selectively oriented rotationally relative to the earth. The coil of tubing at the surface is seldom easy to reorient relative to earth and an orienting motor is needed between top and bottom that will incrementally rotate the lower end relative to the upper end and to maintain the selected relationship while well conditioning operations progress. Common rotary drill strings also often benefit from the ability to change the rotational relationships of axially spaced components. In both applications a drilling motor is commonly used below the orienting motor to drive a drill head or other well conditioning rotary equipment. Pipe strings used in wells for drilling and workover are commonly called drill strings and the two references will be considered interchangeable herein.

It is therefore an object of this invention to provide apparatus to serve as a length of drill string and to rotationally orient the lower end of the string relative to the upper end.

It is another object of this invention to provide the apparatus with means to derive power needed for actuation from the fluid stream moving in the drill string bore.

It is still another object of this invention to provide such an apparatus that will change between active and inactive state in response to selective manipulations of the rate of flow of fluid in the string bore.

It is still another object to provide means within the apparatus to generate a pressure signal in the fluid stream that is detectable at the surface to indicate that the apparatus has actuated to provide an increment of rotary change in the orientation.

These and other objects, advantages, and features of this invention will be apparent to those skilled in the art from a consideration of this specification, including the attached claims and appended drawings.

SUMMARY OF THE INVENTION

An elongated body is arranged to function as a length of drill string having means for fluid tight connection to the continuing string and an axially extending fluid channel to conduct fluids between the separated portions of the string. The body has opposite ends comprised of a housing and an arbor. The arbor is bearingly mounted in the housing for axial constraint and relative rotation. A hydraulic cylinder is arranged in the body for a tubular piston and actuating rod to reciprocate axially, be spring biased to a power stroke starting position, with the piston and rod bore to function as part of the string bore fluid channel. The actuating rod is rotationally affixed to both housing and arbor by cooperating splines. The splines on the arbor have helical pitch different from the helical pitch of the splines in the housing. One cooperating spline pair is connected to the body by an intervening axially affixed member mounted for rotation therein and has a one way clutch rotationally driving the related part of the body such that each power stroke of the piston causes an increment of rotation between opposite ends of the body. A second one way clutch situated to prevent relative rotation, opposite that induced by the power stroke, between opposite ends of the body retains the induced rotation while a spring returns the piston to the starting position.

Reciprocation of the piston is caused by a control valve that is responsive to the piston axial position to close the by pass through the piston at the start, and open it at the end, of the power stroke.

The valve, comprising an orifice in the piston and a cooperating axially movable poppet, is spring biased to the open position. To start the piston power stroke the poppet is forced to the closed state by a control sensor. During the power stroke the valve is held closed by pressure differential across the valve. The valve is opened when the axial travel of the piston brings the poppet to limit stops positioned by a control sensor. Once the valve is opened the differential pressure across it drops, the closing force is lost, and the spring returns the poppet to an open position which it retains during the piston return stroke.

The control sensor is programmed by flow rate manipulations during low, signal level, flow rate. When programmed, the sensor positions the valve in one of two positions defining an on and an off state. One position disables the valve by holding it away from the by-pass orifice in the open state and the orienting motor stays in the existing, or passive, state during high flow operations. The second sensor position, the on state, allows the valve to cooperate with the by-pass orifice to cause reciprocation of the piston and reorienting proceeds, in that active state, until stopped by flow rate reduction.

The sensor is an axially movable annular piston responsive to manipulations of the flow rate of fluid moving in the drill string bore. Fluid flowing in the string bore flows through the sensor piston with some resistance to urge that piston downward against the force of a return spring. At flow rates common to drilling or workover activities the sensor piston is urged downward against limit stops. The sensor piston is axially manipulated at low, signal level, flow rates. The sensor is also a turnstile type turret sleeve with profiled, usually serpentine, grooves cooperating with a cam affixed to the body. Preselected flow rate manipulations allow the cam to negotiate the groove to locate pockets that allow the turret maximum axial travel to to achieve the on state to set the motor into action or to find pockets that hang the turret on the cam after moving a short distance to achieve the off state and allow maximum flow rate without moving the turret into the action permitting position. If the turret, and limit, are stopped after a short travel the limit prevents the closing of the valve and no reciprocation takes place, and no rotation of one end of the drill string relative to the other takes place. If the sensor is manipulated to position the limit cam over a deep pocket the power piston is allowed to reciprocate and the lower end of the string rotates endlessly in incremental steps as long as the fluid flow is maintained above a preselected amount.

The amount of rotation of the lower end of the drill string needs to be known for orientation and that is accomplished by fluid damping the reciprocation to slow the action and to produce a pressure differential, over some time, across the orienting motor that will be detectable at the surface as a pulse in the standpipe pressure. That is done by a dashpot piston mounted on the actuating rod in a sealed and oil filled enclosure. The pressure will fluctuate at the standpipe each time the piston moves axially. Each fluctuation represents a number of degrees of rotation achieved by each cycle of the reciprocator piston. This is a design function characteristic of the tool in use.

DETAILED DESCRIPTION OF DRAWINGS

Figure 1:
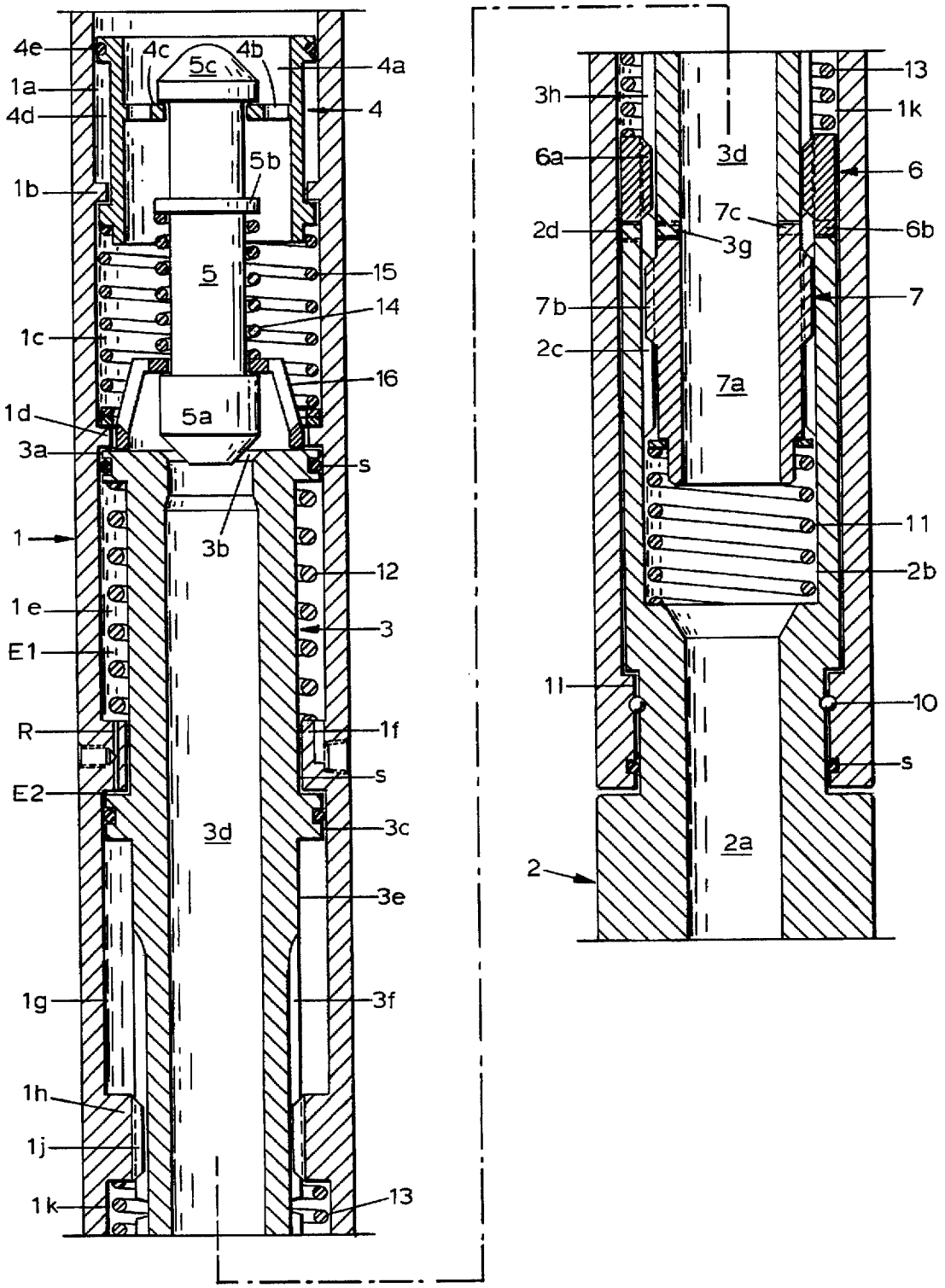
FIG. 1 is a two part, mutually continuous, side view, mostly cut away, of the preferred embodiment in the rest state.
Figure 2:
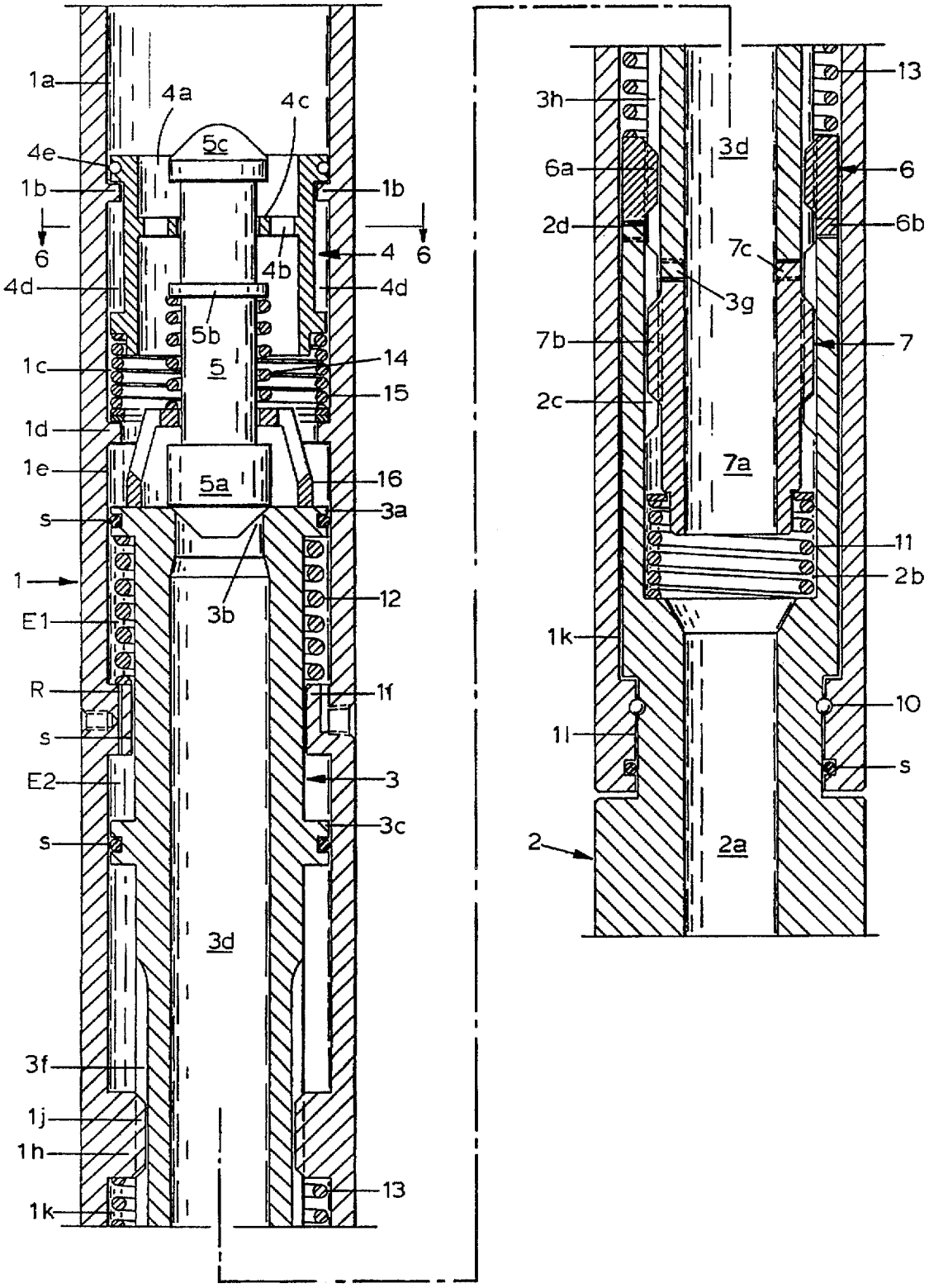
FIG. 2 is identical to FIG. 1 after actuation begins.

In the drawings some features pertaining to manufacturing and maintenance utility, and not bearing upon points of novelty, are omitted in the interest of descriptive efficiency and clarity. Such features may include threaded joining features and fasteners, weld lines, motor details, wiring and plumbing.

In FIG. 1 the orienting motor is shown in the starting or inactive position with no flow moving in the drill string bore which includes bores 4*a*, 3*d*, 7*a*, an 2*a*. The overall body is shown with both upper and lower terminals omitted. The terminals will be pipe string connections. Drill string joints will commonly be used for rotary drill strings. For coiled tubing, the upper and lower connections will be those required for the particular string used and those vary in current field practice. The body comprises housing 1 with output shaft 2 bearingly supported for rotation therein by bearings 10. The bearing shown may be considered symbolic because such bearings are well established in the art and the particular configuration considered optimal for this slow application is now subject to evolution.

Inside housing 1 sensor 4 controls reciprocator 3 which reciprocates axially to drive an axial to rotary motion converter 6 to rotate output 2 an incremental amount with each axial excursion of piston 3*a*. Cylindrical bores 1*a* and 1*c* are continuous with lugs 1*b* extending radially therein. Bore reduction 1*d* provides an axial travel limit for the reciprocator. Bore reduction flange 1*h* provides for splines 1*j*. Bore 1*k* provides radial support for the arbor 2 and has bore reduction 11 to provide for seals and bearings between arbor and housing. Bore 2*b* in the arbor provides for splines 2*c* and spring 11. Where some degree of sealing is used the seals are symbolic and have the caption s.

When orifice 3B is open hydraulic flow losses produce pressure reductions in the flow direction resulting in piston forces acting downwardly on axially movable principal parts. In sensor 4 the relationship between pressure difference due to flow areas 4*b* and spring 15 is such that the sensor moves full down travel at a modest flow rate. The sensor is described in detail for FIGS. 3 and 6 but, briefly here, it is best described as a turnstile arrangement that moves down at even events of flow on-sets, stopping short of the distance needed to activate the reciprocator. With odd events of flow onset it travels far enough for limit 4*c* to force flange 5*b* down to place head 5*a* into orifice 3*b* to activate the reciprocator.

The poppet 5, urged upward by spring 14, has a flow induced pressure difference between top and bottom but spring 14 is sized such that those flow losses due to operating flow rates will never move it down without outside forces being applied. Reciprocator 3 has flow induced pressure difference which acts upward on piston 3*c* and downward on piston 3*a* but spring 12 is sized such that operational flow rates will not move the reciprocator.

Low flow rates will move the sensor down the full permitted travel and, when it is situated to turn the reciprocator on, limit 4*c* engages flange 5*b* and adds compression to spring 14 and forces the poppet head 5*a* into orifice 3*b*. Piston 3*a* now has to move down if flow moves in the drill string bore. Spring 12 is sized such that movement of the piston requires enough pressure to hold poppet head 5*a* in orifice 3*b*, against force of spring 14 until it is lifted from orifice 3*b* by outside force. When the reciprocator nears the lower limit of its travel popper end flange 5*c* engages limit 4*c* and stops poppet down travel. Piston 3*a* still moves down, opening orifice 3*b*, until the pressure across it is reduced. That reduction in pressure will no longer hold the poppet in place because outside force at the start of the stroke invested extra compression in spring 14 and it will move poppet 5 up rapidly, reducing the pressure difference across piston 3*a* to flow loss effect alone. Upward movement of piston 3*a* will not recapture the poppet head because lantern 16, supporting spring 14, rides upward on piston 3*a* and maintains the open condition. Upward movement of the reciprocator begins more slowly than the poppet because it has more weight produced inertia.

An optional feature includes oil filled enclosures E1 and E2 between pistons 3*a* and 3*c*, which allows the reciprocator to move only by oil flowing past bore reduction 1*f* through resistance R. This slows downward travel to produce a pressure pulse in the drill string flow detectable at the surface. This also slows upward travel of the reciprocator, further preventing recapture of the poppet head by orifice 3*b*. If sensor 4 is still down when the reciprocator nears the upward limit of its travel, limit 4*c* again stops the popper and orifice 3*b* is thrust against head 5*a* to repeat the process endlessly until flow is essentially stopped.

If flow down the drill string is stopped the sensor 4 moves up, as shown in FIG. 1, and the poppet will not close the orifice and the reciprocator stops at the limit of the up stroke and retains the setting achieved by whatever down strokes were already accomplished.

The energy required to generate a pressure change signal pulse in a fluid flowing in a pipe string bore has a hold, or dwell, time and a pressure change factor related to the distance the detectable pulse must travel. Dwell time is not to be confused with pulse travel time. To assure control of both dwell time and signal pressure change the axial excursion of the piston is slowed by oil flowing between enclosures E1 and E2 through resistor R. That resistor, in cooperation with the rate of flow of fluid in the pipe string bore, defines the change in standpipe pressure when the poppet opens. The oil filled enclosure is defined by pistons 3*a* and 3c moving in bores 1e and 1g respectively. Fluid has to pass the barrier 1f when the reciprocator moves. The spring induced power piston return stroke is slowed too. The slow return allows the pressure change in the fluid flowing in the drill string to reach the surface to be interpreted as cycle indications which, in turn, represent a design selected number of degrees of rotation of the lower end of the motor, and the lower end of the drill string, relative to the upwardly continuing drill string to which the orienting motor is attached. The driller must be able to take whatever action is needed before the down hole system proceeds with an unneeded cycle.

Figure 3:
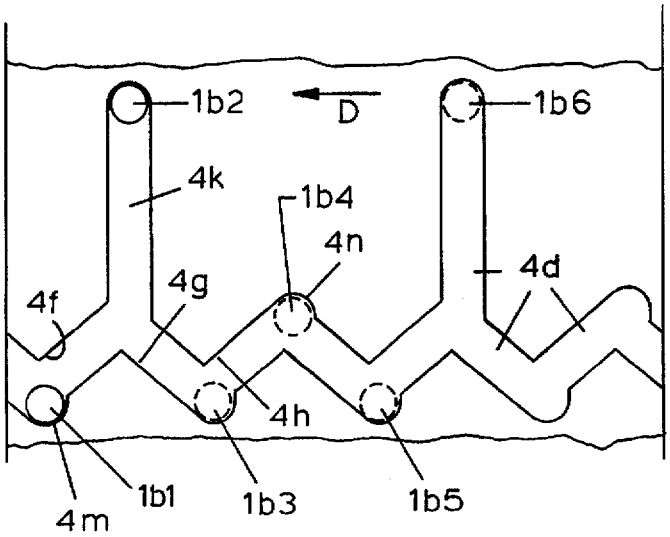
FIG. 3 is a development, enlarged, of a selected area of FIGS. 1 and 2.
Figure 6:
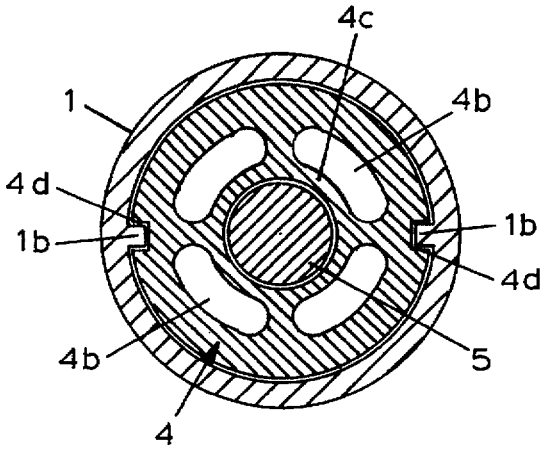
FIG. 6 is a sectional view taken along line 6—6 of FIG. 2.

The function of sensor 4 is best understood after presentation of FIGS. 3 and 6. The sensor is an annular piston with some resistance, partly due to the sizing of holes 4b, in bore 4a through which the mud stream flows. Flow urges it downward and spring 15 urges it upward. The relationship between resistance and spring force is such that the flow rate of normal operations thrusts the sensor against limit stops. Manipulation of the sensor takes place at low flow rates. At least one cam lug 1b engages groove 4d. Groove 4d is a profiled, generally serpentine, groove. The sensor has seals 4e which resist rotation but provide limited friction. When the sensor moves axially lug 1b engages groove buttresses such as 4f, 4g, or 4h which are shaped to rotate the sensor in a selected direction shown by arrow D. The starting, or no flow, position for lug 1b is shown as 1b1. When flow starts the sensor moves down and the lug hits buttress 4f to rotate the sleeve and admit the lug to position 1b2 in pocket 4k which lowers limit 4c to start reciprocation of the motor. When the flow is sufficiently reduced, the lug moves to position 1b3 in one of the rests 4m. When flow is next started the lug moves to the shallow pocket 4n and the sensor limit 4c still holds the poppet too high for the orifice to be closed and no reciprocation takes place. Groove 4d is continuous and the resetting can proceed indefinitely.

At the surface, the operational state of the orienting motor is detected by the presence or absence of pulses. To change the state, the mud flow is simply stopped and restarted.

Figure 4:
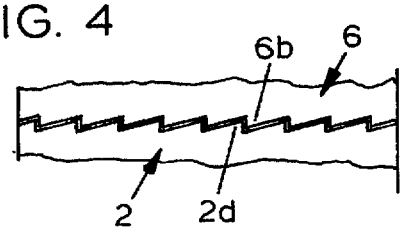
FIG. 4 is a development of the outer surface of one way clutch ratchet teeth viewed toward the center line.

To convert axial movement to rotary movement a differential helix spline arrangement is used. Spline pair 1j and 3f are preferably straight and pair 3h and 6a have left hand helix. Hub 6 rotates when the reciprocator 3 moves. Hub 6 is part of a one way clutch comprising sprocket teeth 6b and 2d and spring 13. FIG. 4 shows a surface development, viewed toward the centerline, of the mating teeth. Converter 6 drives arbor 2 clockwise from the top on the reciprocator power stroke and free-wheels backward on the up-stroke.

Figure 5:
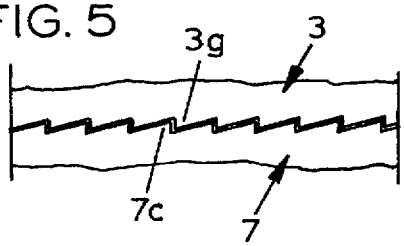
FIG. 5 is the same as FIG. 4 for a different one way clutch.

Clutch 7 rotationally connects arbor 2 to housing 1 by way of splines 2c and 7b, sprocket teeth 3g and 7c, and splines 1j and 3f. Spring 11 urges teeth 3g and 7c into contact to hold the relationship between housing and body unless the reciprocator is advancing the orientation of arbor and housing. FIG. 5 shows a surface development of the teeth, viewed toward the centerline. In applications where radial space is adequate the holding clutch can be located to more directly connect arbor and housing.

From the foregoing, it will be seen that this invention is one well adapted to attain all of the ends and objects hereinabove set forth, together with other advantages which are obvious and which are inherent to the tool.

It will be understood that certain features and sub-combinations are of utility and may be employed without reference to other features and sub-combinations. This is contemplated by and is within the scope of the claims.

As many possible embodiments may be made of the tool of this invention without departing from the scope thereof, it is to be understood that all matter herein set forth or shown in the accompanying drawings is to be interpreted as illustrative and not in a limiting sense.

The invention having been described, I claim:

1. An orienting motor for use in well bores as a length element of a fluid conducting pipe string to rotate one end of the pipe string relative to the other end, comprising:

a) a generally elongated body with means at each end for fluid tight attachment to continuing pipe string portions, said body comprising a housing end bearingly connected to an arbor end for relative rotation therebetween;

b) a fluid by pass channel in said body to conduct fluid between said portions of said pipe string;

c) a hydraulic cylinder in one of said ends arranged for a piston therein to reciprocate axially between first and second positions with opposed active faces of said piston in fluid communication with opposite ends of said channel, said piston spring biased to said first position and urged toward said second position when fluid flows in the drill string and said by pass is closed;

d) axial-to-rotary motion converter means, with an associated rotary drive element, arranged to cooperate with said piston to convert axial movement of said piston to rotary movement of said rotary drive element relative to one end of said body;

e) first one-way drive means to connect said rotary drive to the other end of said body and arranged to drive said other end in a selected rotational direction in response to axial reciprocation of said piston;

f) second one way drive means situated between said two ends to prevent rotation of said other end in a direction opposite said selected direction; and g) control valve means responsive to the axial positions of said piston, arranged to close said by pass channel when said piston is at said first position for start of a power stroke and open said by pass channel when said piston reaches said second position.

2. The orienting motor of claim 1 wherein sensor means is provided in said body and is arranged to respond to preselected manipulations of the rate of fluid flow in said pipe string to change between an on state and an off state and when in said off state to disable said control valve to prevent closing of said by pass channel.

3. The orienting motor of claim 1 wherein speed control means is provided to regulate the rate of movement of said piston at least during said power stroke to cause a pressure increase in fluid moving in said pipe string to produce a pressure pulse detectable at the surface to indicate that at least the power stroke is in progress.

4. The orienting motor of claim 3 wherein said speed of said piston is regulated when moving from said second to said first position.

5. The orienting motor of claim 1 wherein said piston is tubular and said by pass channel extends therethrough.

6. The orienting motor of claim 5 wherein said control valve comprises a poppet element in cooperation with the bore of said piston to close said by pass channel.

7. The orienting motor of claim 6 wherein a sensor, in response to preselected manipulations of the rate of flow of fluid moving in said pipe string, acts to disable said valve in the open position to prevent motor operation by holding said poppet away from said piston.

8. An orienting motor for use in well bores as a length element of a fluid conducting pipe string to rotate one end of the pipe string relative to the other end, comprising:

a) a generally elongated body with means at each end for fluid tight attachment to continuing pipe string portions, said body comprising a housing end bearingly connected to an arbor end for relative rotation therebetween;

b) a hydraulic cylinder axially distributed in said body with a tubular piston and actuating rod, arranged to move axially between a first and a second position, with a first spline on said rod arranged to cooperate with a mating first spline on one of said ends and a second spline of a different helix angle aranged to cooperate with a second mating splined element mounted on the other end of said body to produce relative rotation between said ends when said piston moves axially;

c) a one way clutch situated between said splined element and said other end to rotate said other end in only a selected rotational direction when said piston moves axially;

d) a second one way clutch situated between said two ends to prevent rotation of said other end in a direction opposite said selected direction; and e) a control valve comprising a poppet arranged to cooperate with the bore of said tubular piston, responsive to the position of said piston, to occlude the bore when said piston arrives at said first axial position and to move to open said bore when said piston arrives at said second axial position, such that said piston will respond to flow of fluid in said pipe string to oscillate between said first and said second positions.

9. The orienting motor of claim 8 wherein a sensor is arranged to cooperate with said poppet to restrain it in the open state in response to preselected manipulations, having a first characteristic, of the rate of flow of fluid in the pipe string bore and to respond to preselected manipulations, having a second characteristic, of the rate of flow of fluid in the pipe string bore to allow said poppet to respond to said positions of said piston to open and close said bore.

10. The orienting motor of claim 9 wherein said actuating rod is provided with a dashpot piston and cooperating bore to regulate the speed of axial movement of said piston in at least one direction to provide means to produce movement resistance to provide a consequent increase in pressure required, to force flow along the pipe string bore that can be detected at the surface to relate pressure changes to piston power strokes and, hence, to degrees of change in the rotational position of said motor.

* * * * *